US008498436B2

(12) United States Patent
Cheng et al.

(10) Patent No.: US 8,498,436 B2
(45) Date of Patent: Jul. 30, 2013

(54) HEARING DEVICE WITH A CONDUCTING ELEMENT, IN PARTICULAR A SOUND TUBE

(75) Inventors: Phanhow Amy Cheng, Singapore (SG); Markus Heerlein, Kitzingen (DE); Harald Klemenz, Fürth (DE); Cheoung Hong Lee, Singapore (SG); Meng Kiang Lim, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 218 days.

(21) Appl. No.: 13/037,845

(22) Filed: Mar. 1, 2011

(65) Prior Publication Data

US 2011/0211716 A1 Sep. 1, 2011

(30) Foreign Application Priority Data

Mar. 1, 2010 (DE) ..... 10 2010 009 702

(51) Int. Cl.
*H04R 25/00* (2006.01)

(52) U.S. Cl.
USPC ..... 381/322; 381/324

(58) Field of Classification Search
USPC ..... 381/322, 324, 330, 312
See application file for complete search history.

(56) References Cited

U.S. PATENT DOCUMENTS

| | | | | |
|---|---|---|---|---|
| 3,732,382 | A | 5/1973 | DeWitt | |
| 3,813,499 | A * | 5/1974 | Vignini | 381/330 |
| 4,564,955 | A | 1/1986 | Birch et al. | |
| 5,134,655 | A | 7/1992 | Jensen | |
| 5,204,917 | A | 4/1993 | Arndt et al. | |
| 5,475,192 | A | 12/1995 | Inagaki et al. | |
| 5,488,205 | A | 1/1996 | Major | |
| 7,602,929 | B2 * | 10/2009 | Topholm et al. | 381/322 |
| 2003/0091210 | A1 | 5/2003 | Baskerville | |
| 2007/0147643 | A1 | 6/2007 | Grafenberg | |
| 2009/0041277 | A1 * | 2/2009 | Kral et al. | 381/324 |

FOREIGN PATENT DOCUMENTS

| | | | |
|---|---|---|---|
| DE | 3720591 | A1 | 1/1988 |
| DE | 4116533 | C1 | 7/1992 |
| DE | 102005061795 | A1 | 7/2007 |
| DE | 102007037877 | B3 | 1/2009 |
| EP | 0087668 | A1 | 9/1983 |

* cited by examiner

*Primary Examiner* — Curtis Kuntz
*Assistant Examiner* — Sunita Joshi
(74) *Attorney, Agent, or Firm* — Laurence A. Greenberg; Werner H. Stemer; Ralph E. Locher

(57) ABSTRACT

In a hearing aid provision can be made for a housing that is worn outside of an auditory canal of a user. Then, sound or electrical signals are conducted into the auditory canal from the housing. To this end, provision can be made for a conducting element such as a sound tube or a cable. The conducting element is then connected to the housing via a coupling element. This connection must be embodied such that the coupling element does not detach from the housing on its own accord. The user must be able to remove the coupling element and the conducting element from the housing in a simple fashion in order e.g. to be able to clean the former two parts. Accordingly, a coupling element and a housing can be interconnected in a detachable fashion, with this connection containing a dovetail joint for the hearing aid.

8 Claims, 4 Drawing Sheets

HEARING DEVICE WITH A CONDUCTING ELEMENT, IN PARTICULAR A SOUND TUBE

CROSS-REFERENCE TO RELATED APPLICATION

This application claims the priority, under 35 U.S.C. §119, of German application DE 10 2010 009 702.0, filed Mar. 1, 2010; the prior application is herewith incorporated by reference in its entirety.

BACKGROUND OF THE INVENTION

Field of the Invention

The invention relates to a hearing device with a housing and a conducting element, by which sound or electrical signals can be conducted from the housing to another element of the hearing device, e.g. an earpiece. The conducting element is held against the housing by a coupling element. Here, the coupling element is connected to the housing in a reversibly detachable fashion, i.e. the coupling element can be detached from the housing without being destroyed and can also be reattached thereto. Here, the term hearing device is understood to mean a hearing aid in particular. However, the term moreover also encompasses other portable acoustic instruments, such as headsets, headphones or the like.

Hearing aids are portable hearing devices used to support the hard of hearing. In order to make concessions for the numerous individual requirements, different types of hearing aids are provided, e.g. behind-the-ear (BTE) hearing aids, hearing aids with an external receiver (receiver in the canal [RIC]) and in-the-ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids, implantable or vibrotactile hearing aids are also commercially available. In this case, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually configured as an electroacoustic transducer, e.g. a miniaturized loudspeaker, or as an electromechanical transducer, e.g. a bone conduction receiver. The amplifier is usually integrated into a signal-processing unit. This basic configured is illustrated in FIG. 1 using the example of a behind-the-ear hearing aid. One or more microphones 2 for recording the sound from the surroundings are installed in a hearing-aid housing 1 to be worn behind the ear. A signal-processing unit 3, likewise integrated into the hearing-aid housing 1, processes the microphone signals and amplifies them. The output signal of the signal-processing unit 3 is transferred to a loudspeaker or receiver 4, which emits an acoustic signal. If necessary, the sound is transferred to the eardrum of the aid wearer using a sound tube, which is fixed in the auditory canal with an ear mold. A battery 5, likewise integrated into the hearing-aid housing 1, supplies the hearing aid and, in particular, the signal-processing unit 3 with energy.

The sound tube of a hearing aid is a conducting element for conducting sound. It allows the targeted transmission of sound, produced in the receiver 4, into the auditory canal. A connection between the sound tube and the hearing-aid housing 1 is often made possible by an ear hook. The latter can then also be used to hook the hearing-aid housing 1 behind an auricle of the aid wearer. The ear hook acoustically couples the sound tube to a sound-outlet opening of the housing 1. Hence, it is a coupling element, by which sound produced by the receiver 4 can be guided into the sound tube. In the case of hearing aids that are not worn behind the ear, but rather e.g. in a concha of an auricle, a much smaller coupling element is used, instead of an ear hook, for connecting the sound tube to the hearing-aid housing.

It must be possible to remove the coupling element of a hearing aid, and the sound tube connected thereto, from the hearing-aid housing in order to clean the sound tube or be able to replace the latter with a new sound tube. The aid wearer himself/herself should be able to undertake the removal. Hence, it must be possible to detach, and re-establish, the connection between the coupling element and the hearing-aid housing in the simplest possible fashion. On the other hand, the coupling element must not already detach from the housing if the aid wearer for example accidentally brushes along the sound tube with his/her hand and thereby pulls the coupling element.

The coupling element is generally screwed onto a connection piece that protrudes from the housing. Sound, produced by a receiver in the interior of the housing, can also emerge from the housing through this connection piece. The sound-connection piece can have a male thread, onto which the coupling element can be screwed. However, a disadvantage of this connection is that after the coupling element has been screwed on and off a number of times, a thread in the interior of the coupling element is affected by wear and tear, and so the coupling element can no longer be connected to the housing in an acoustically sealed fashion. This can lead to undesired feedback of the sound produced by the receiver in a microphone of the hearing aid. Moreover, parts of the thread can detach from the coupling element and enter the sound-connection piece or the sound tube. This then negatively affects the transmission of the sound into the auditory canal.

In a hearing aid with an external receiver (RIC), the sound is produced directly in the auditory canal of the aid wearer by an in-the-ear loudspeaker. In this hearing aid, provision is made for a cable, rather than a sound tube, between a housing of the hearing aid situated outside of the auditory canal and the loudspeaker. This cable serves as a conducting element for electrical signals that are transmitted from the housing outside of the auditory canal to the loudspeaker in the auditory canal. Here a cable is understood to mean an arrangement of one or more wires with associated insulation.

A cable for an in-the-ear loudspeaker must also be connected to the housing situated outside of the auditory canal in a reversibly detachable fashion. As in the case of a sound tube, the aid wearer must find it easy to detach this connection as well. Nevertheless, it likewise must not detach on its own accord in the case of a slight pull on the cable. A corresponding coupling element for connecting the cable to the housing must not wear excessively quickly either because otherwise the coupling element would be seated too loosely on the housing and this would then result in sporadic interruptions of an electrical connection between contacts of the coupling element, on the one hand, and contacts of the housing, on the other hand.

Another problem often associated with electrical contacts in hearing aids is that these contacts become dirty. Then, a desired electrical connection is no longer guaranteed when two contacts touch. Such contacts can also be situated in the interior of the housing of the hearing aid. In the case of such contacts situated on the inside, dirt can for example enter a shell of the housing, into which a switch of the hearing aid has been inserted, through a gap.

SUMMARY OF THE INVENTION

It is accordingly an object of the invention to provide a hearing device with a conducting element, in particular a sound tube which overcomes the above-mentioned disadvantages of the prior art devices of this general type, which is an improve hearing device to the effect that it functions more reliably.

The hearing device according to the invention contains a housing and a conducting element for conducting sound and/or electrical signals. The conducting element is held against the housing by a coupling element. The coupling element is connected to the housing in a reversibly detachable fashion. Here, the connection, by which the coupling element is connected to the housing, contains a dovetail joint. By way of example, such a dovetail joint can be provided by forming a projection, which is undercut on at least one side, on one of the two components, for example the housing. The other component can then be provided with a recess, by which the component can be pushed onto the projection. In the process, the undercut results in a form-fit in a direction at an angle to the direction of the push.

Connecting the coupling element to the housing by a dovetail joint immediately results in a number of advantages. Compared to a connection by a thread, there is only little wear and tear on the components of a dovetail joint during the connection and detachment process. Hence, the conducting element can still be reliably connected to the housing after the coupling element has been detached from the housing, and reconnected thereto, a large number of times. Handling the hearing device according to the invention is also particularly simple. Thus, an aid wearer can connect the coupling element to the housing without much effort. Nor is there a risk in the case of a dovetail joint of parts of the coupling element becoming detached and for example blocking a sound tube. Further advantages emerging from the hearing device according to the invention are explained in conjunction with an exemplary embodiment.

The hearing device according to the invention is advantageously developed by the coupling element for the connection to the housing being pushed on at an angle to a direction of extent, in which the conducting element extends away from the coupling element. Here it is particularly advantageous for the coupling element for the connection to the housing to be pushed on perpendicularly to this direction of extent. This results in the advantage of the coupling element not becoming detached from the housing if the aid wearer accidentally pulls on the conducting element.

A further advantageous embodiment of the hearing device according to the invention arises from a housing-side component of the dovetail joint being configured in an integral fashion on a shell part of the housing. Then the shell part and the housing-side component of the dovetail joint can be produced in a single working step. This results in the advantage of being able to reduce the costs for producing a hearing device according to the invention.

Should a sound transducer for producing sound be situated in the housing, an advantageous development arises from the housing and the coupling element each having a passage opening in the region of the dovetail joint. Sound produced in the interior of the housing can then emerge from the housing through this passage opening and enter the conducting element via the coupling element. This development is based on the discovery that the housing and the coupling element are held together particularly tightly in the region of the dovetail joint. Since the passage openings for transmitting the sound into the coupling element from the housing are provided in this region, this results in the advantage of allowing a particularly tight acoustic coupling between these two components. In other words, this particularly effectively prevents sound from undesirably emerging from the hearing device and causing feedback, as already described in conjunction with a sound-outlet connection piece.

If the housing or the coupling element has a base, which is a component of the dovetail joint, an advantage furthermore arises if an end face of the base contains one of the passage openings. By way of example, such a base can form that projection in the dovetail joint with the already described undercut. In particular, a base should be understood to mean a raised structure with a cuboid basic shape. The end face is a face of the base where a surface normal points away from the housing. Providing one of the passage openings in the end face advantageously results in it being particularly simple to clean the hearing device in the region of the passage opening.

A further advantage arises if one of the passage openings is surrounded by an O-ring. Such an arrangement can allow the hearing device to be particularly tight acoustically in the region of the dovetail joint. In doing so, this development is based on the discovery that the region in which the sound passes into the coupling element from the housing can also be sealed acoustically by an O-ring if part of the coupling element has to glide over the O-ring when the coupling element is pushed onto the housing. The O-ring is not damaged in the process. As soon as the coupling element has been completely pushed onto the housing such that the dovetail joint is established, the ring nevertheless seals as desired. O-rings as such are known from the prior art. However, these are usually used for sealing e.g. a line, made of two pipes that are stuck into one another, at a transition site between the pipes.

Should, in the hearing device according to the invention, electrical signals be transmitted into the conducting element from the housing, an advantage arises if, in the region of the dovetail joint, the housing and the coupling element each have at least one electrical contact for transmitting an electrical signal. Then the contacts that need to touch in order to transmit the signal are pressed against one another particularly well. This advantageously ensures that there is an electrical connection even if there is e.g. dirt on the electrical contacts. This development of the hearing device according to the invention is also based on the discovery that the housing and the coupling element are held together particularly tightly in the region of the dovetail joint.

Provision can be made for a conducting element to be configured both for conducting sound and for conducting electrical signals. Then, for example, a control signal for an active element in an auditory canal can also be conducted in addition to sound. An earpiece that can adjust its shape by an actuator is an example of such an active element.

A further aspect of the invention relates to a conduction arrangement for the hearing device according to the invention. The conduction arrangement contains a conducting element for conducting sound and/or electrical signals, and a coupling element, by which the conducting element can be connected to a housing of the hearing device in a detachable fashion. It goes without saying that such a conduction arrangement can be produced independently of the remainder of the hearing device.

Other features which are considered as characteristic for the invention are set forth in the appended claims.

Although the invention is illustrated and described herein as embodied in a hearing device with a conducting element, in particular a sound tube, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 2:
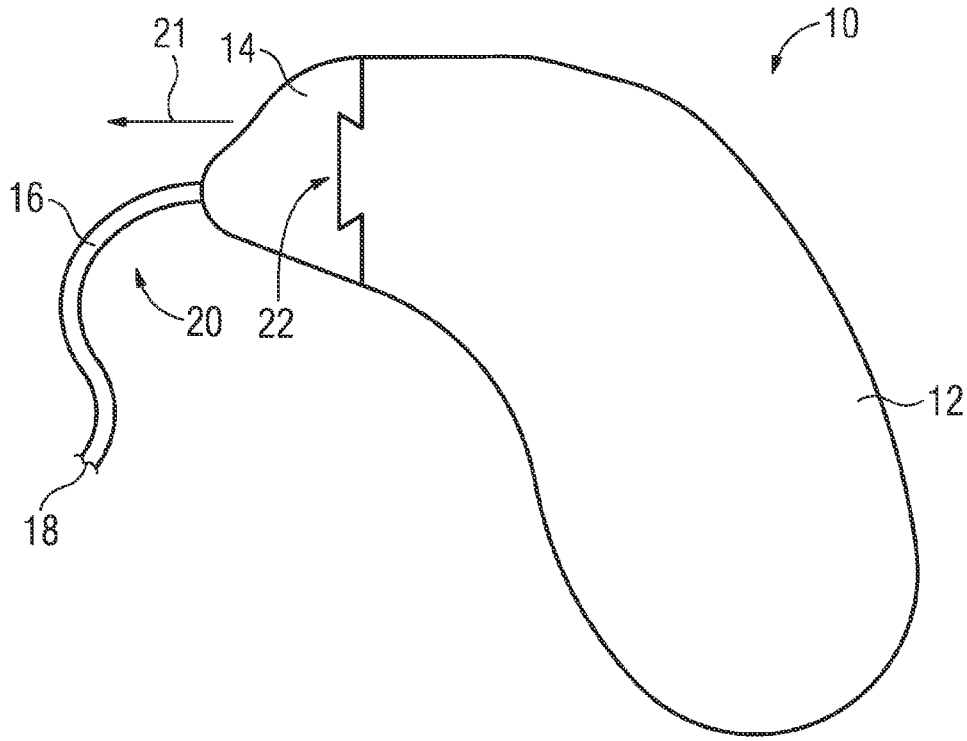
FIG. 2 is a diagrammatic, side view of a hearing aid as per a first embodiment of the hearing device according to the invention.

Referring now to the figures of the drawing in detail and first, particularly, to FIG. 2 thereof, there is shown a behind-the-ear hearing aid 10 with a housing 12, an ear hook 14 and a sound tube 16. The sound tube 16 has merely been illustrated in part. Part of the sound tube 16 that has not been illustrated extends beyond a break line 18 shown in FIG. 2.

Figure 1:
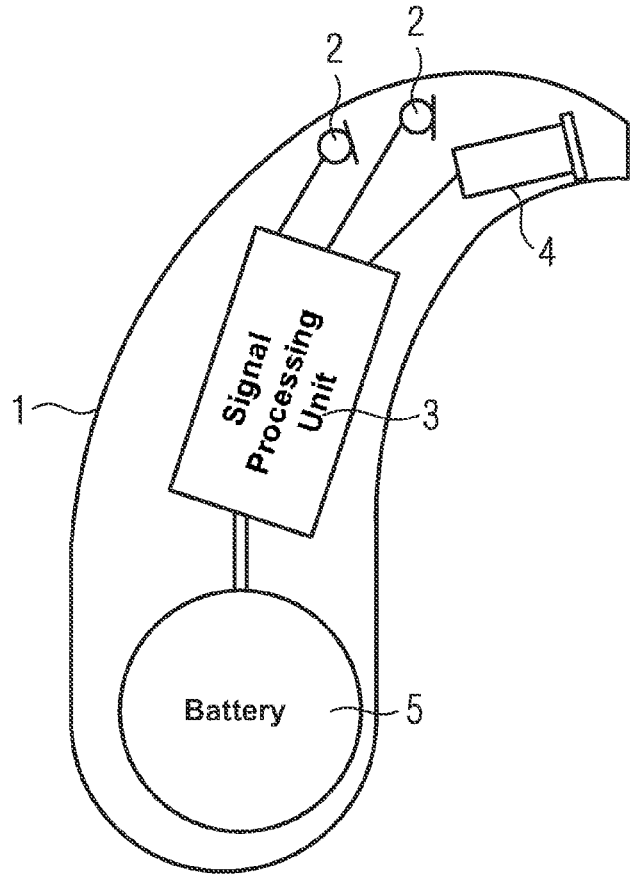
FIG. 1 PRIOR ART
FIG. 1 is a diagrammatic, illustration of a design of a behind-the-ear hearing aid, without sound tube or earpiece according to the prior art.

A configuration of the hearing aid 10 in an interior of the housing 12 is comparable to that of the hearing aid described in conjunction with FIG. 1. When a hearing-aid wearer wears the hearing aid 10, the ear hook 14 and an attachment region 20 of the sound tube 16 rest against an auricle of the hearing-aid wearer such that the housing 12 is held behind the auricle as a result of this.

The housing 12 is connected to the ear hook 14 in a reversibly detachable fashion by a dovetail joint 22. The ear hook 14 is a coupling element for enabling the reversibly detachable connection between the sound tube 16 and the housing 12.

The flexibility of the sound tube 16 is constrained in the attachment region 20 because part of the attachment region sticks in a recess in the ear hook 14. At an opening of the ear hook 14 formed by the recess, the sound tube 16 extends away from the ear hook 14 along a direction of extent 21.

An earpiece of the hearing aid 10, by which the end of the sound tube 16 can be fixed in an auditory canal, is at one end of the sound tube 16, not illustrated in FIG. 2. The sound tube is a conducting element for conducting sound to the earpiece.

Figure 3:
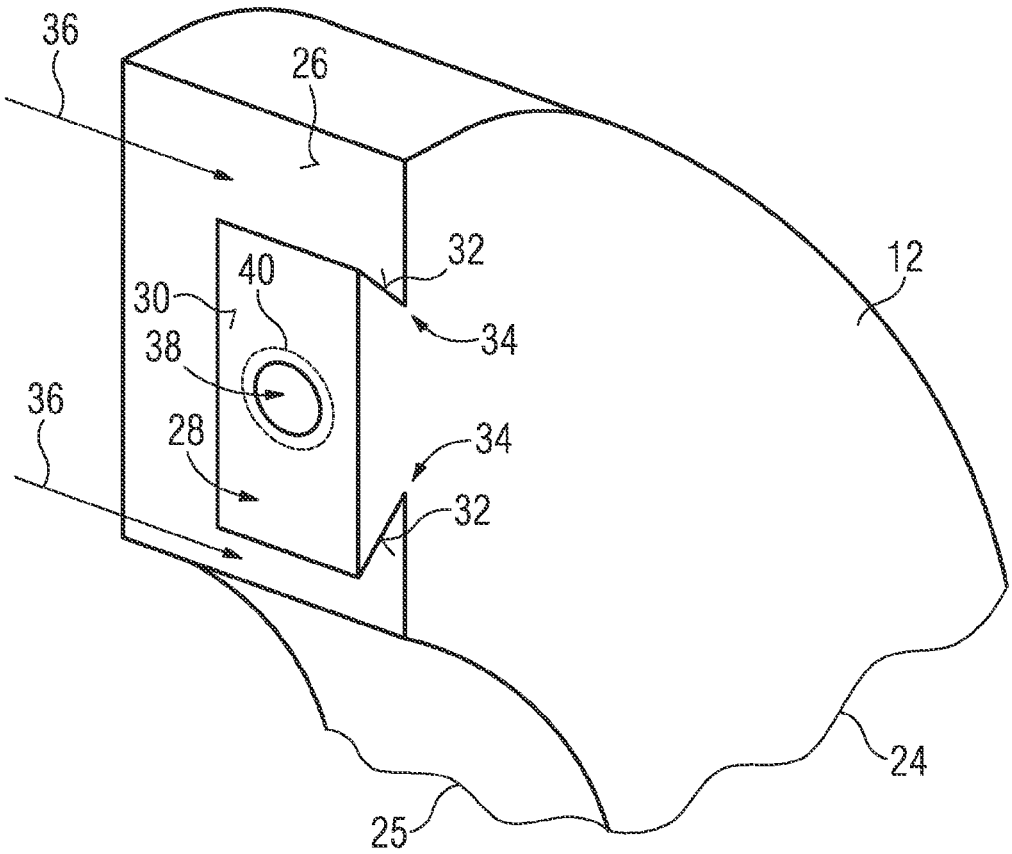
FIG. 3 is a perspective view of a housing-side component of a dovetail joint of the hearing aid illustrated in FIG. 2.

FIG. 3 once again illustrates the housing 12, with the ear hook 14 (not illustrated) having been detached from the housing 12 in FIG. 3. The housing 12 has only been illustrated in part; the part that has not been illustrated extends beyond break lines 24, 25.

By detaching the ear hook 14 from the housing 12, a planar surface 26 has been uncovered. A base 28 is formed on the housing 12 in the region of the surface 26, which base constitutes a projection with respect to the surface 26, i.e. the base 28 is a raised structure of the housing 12. The base 28 can be integrally formed with a shell part of the housing 12.

The base 28 is part of the dovetail joint 22. With respect to an end face 30 of the base 28, side walls 32 of the base 28 are inclined such that there is an undercut 34 on the base 28. The undercut 34 forms guides along which the ear hook 14 can be pushed onto the base 28 in order to form the dovetail joint 22. Here, the ear hook 14 must be pushed onto the base 28 along a push direction 36. The push direction 36 is perpendicular to a direction of extent 21.

Once the ear hook 14 has been pushed onto the base 28, there is, in the region of the undercut 34, a form-fit with respect to the direction of extent 21 between the base 28 and the ear hook 14. Should the sound tube 16 then be pulled such that a force in the direction of the direction of extent 21 is exerted on the ear hook 14, the ear hook 14 is held on the housing 12 against this force by the base 28. Nevertheless, a user of the hearing aid can easily remove the ear hook 14 from the housing 12. To this end, the user simply needs to push the ear hook 14 from the base 28 against the push direction 36.

The end face 30 has a sound-outlet opening 38. Sound produced by a receiver in the interior of the housing 12 can emerge from the housing 12 through the sound-outlet opening. The sound-outlet opening 38 is surrounded by an O-ring 40. The O-ring 40 is merely indicated by a dashed line in FIG. 3. When the ear hook 14 is connected to the housing 12, the O-ring 40 presses against a wall of the ear hook 14 that is opposite to the end face 30. As a result, the O-ring 40 prevents sound, emerging from the sound-outlet opening 38, from escaping the hearing aid 10 from between the base 28 and the ear hook 14 in the region of the dovetail joint 22.

Figure 4:
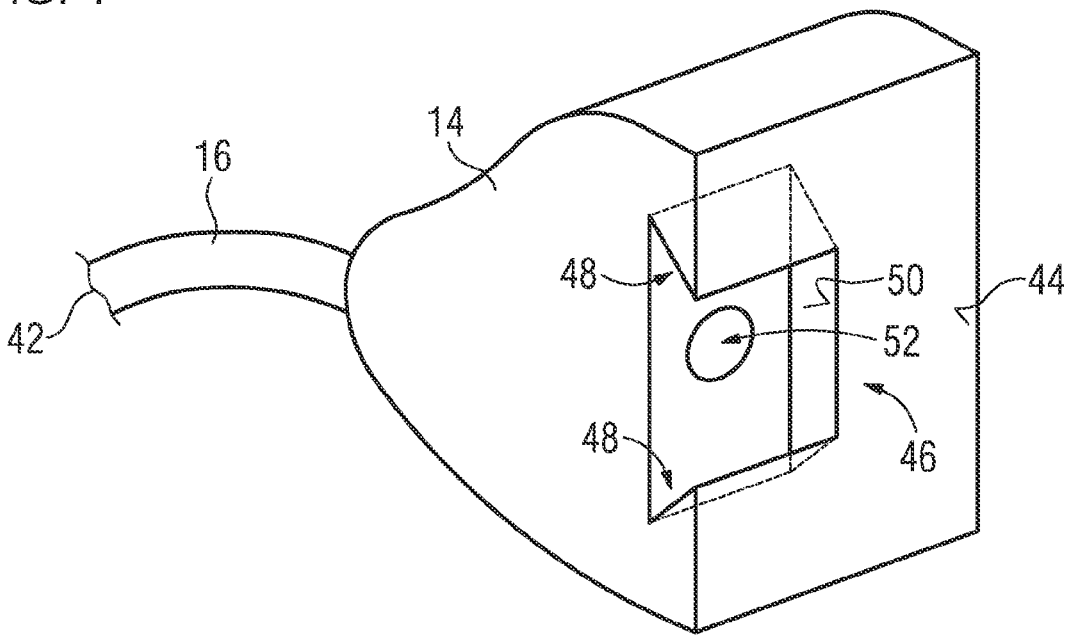
FIG. 4 is a perspective view of a coupling element and a sound tube connected thereto, which together form an embodiment of a conduction arrangement for the hearing aid illustrated in FIG. 2.

FIG. 4 illustrates the ear hook 14 on its own, i.e. without the housing 12. The sound tube 16 is again only illustrated in part; a part that has not been illustrated extends beyond a break line 42. The sound tube 16 is fixedly connected to the ear hook 14. Together these two parts form a conduction arrangement for the hearing aid 10.

When the ear hook 14 is connected to the housing 12, a contact surface 44 of the ear hook 14 butts against the surface 26 of the housing 12. The contact surface 44 has a recess 46. A shape of the ear hook 14 in the region of the recess 46 corresponds to a shape of the base 28. The contours of edges of the ear hook 14, which cannot be seen in the perspective view of FIG. 4, are indicated in FIG. 4 by dashed lines. It can be seen that the ear hook 14 has an undercut 48 in the region of the recess 46. The ear hook 14 can be pushed onto the housing 12 and onto the base 28 along the push direction 36 such that the base 28 glides into the recess 46 from the left-hand side in FIG. 4. The base 28 can be pushed into the recess 46 until it butts against a wall 50 of the ear hook 14. The base 28 then completely fills the recess 46. A sound-inlet opening 52 of the ear hook 14 then lies opposite the sound-outlet opening 38 such that sound can pass out of the housing 12 through the sound-outlet opening 38 and into the ear hook 14 through the sound-inlet opening 52. From there the sound is then guided into the sound tube 16. The sound-outlet opening 38 and the sound-inlet opening 52 are sound passage openings.

The hearing aid 10 can be provided with a locking mechanism that then makes it possible to block a push movement that can push the ear hook 14 off the base 28. By way of example, this then prevents an infant from independently being able to detach the ear hook 14 from the housing 12.

The dovetail joint allows a hearing-aid wearer to detach the ear hook from the housing with little effort. By allowing the base for the dovetail joint to be formed as a component of a shell part of the housing or of the ear hook, it is no longer necessary to provide e.g. a sound-connection piece made of steel as a separate component, as may be the case in a corresponding hearing aid from the prior art. Provision can also be made for the base to be configured as a component of a frame for holding a circuit arrangement of the hearing aid. This also results in the just-mentioned advantage.

A hearing aid from the prior art can be redesigned with little effort in order to result in a hearing device according to the invention. Only a few working steps have to be modified to this end. After all, the example also shows how the dovetail joint and the O-ring ensure that the region between the housing and the ear hook is acoustically tight.

The following text describes how dirt, such as dust or skin particles, and moisture, e.g. sweat or water, can be prevented from entering the interior of the housing in a hearing device, more particularly in a hearing aid.

Dirt and moisture can corrode mechanical switches or surface mounted device (SMD) components of electrical circuits, or mechanically damage these in another fashion. Dirt and moisture often penetrate a gap situated between a switch of the hearing device and a housing part surrounding the switch. Hence, in general, it is attempted to configure these gaps to be as narrow as possible. However, the precision required for this during the production of the components makes a hearing device expensive. Provision can also be made for coating a surface of the hearing device such that sweat and water drip off the surface particularly well. However, this additional coating is also expensive.

Figure 5:
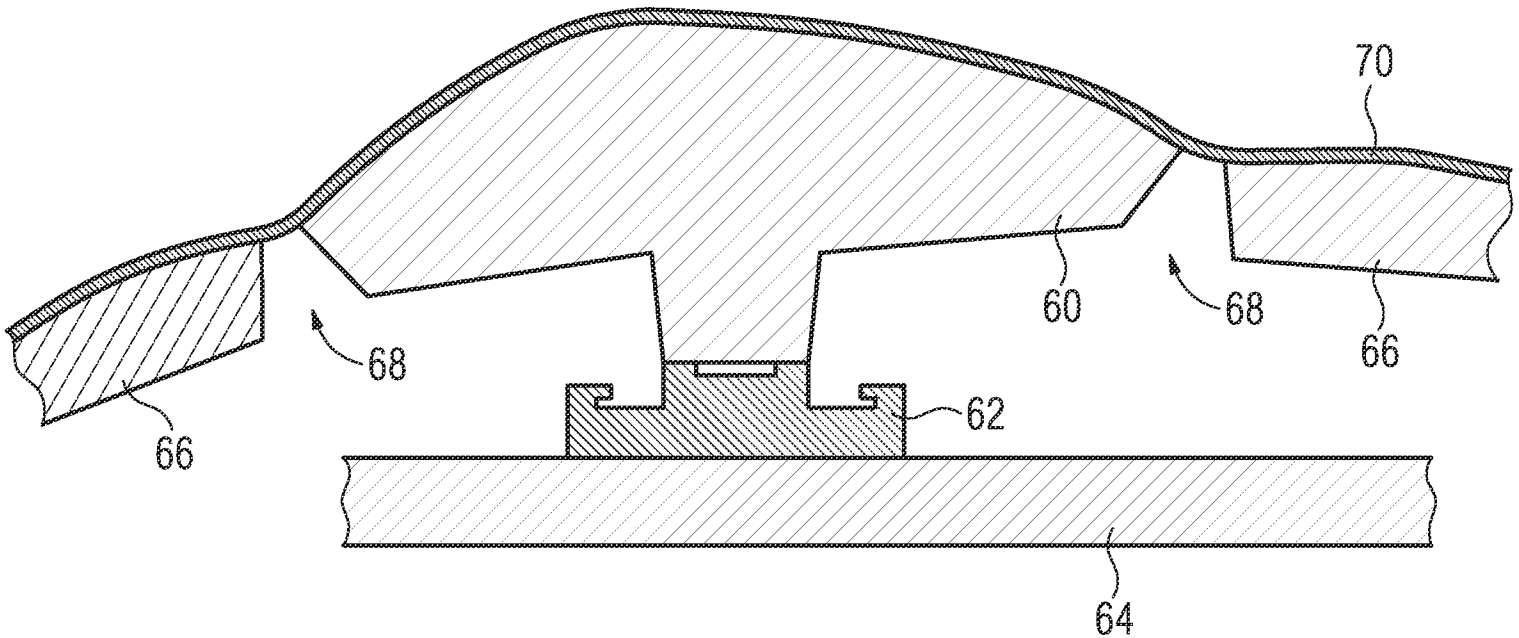
FIG. 5 is a cross-sectional view of a switch of a hearing aid, wherein gaps between the switch and a shell part of a housing are sealed by means of a film.

FIG. 5 shows a button 60 of a hearing device, by which button a user can switch an electrical switch 62. By way of example, the button 60 can be produced from plastic, e.g. an acrylonitrile butadiene styrene copolymer (ABS), or rubber, e.g. silicone rubber. The switch 62 is part of an electrical circuit arrangement of the hearing device. A printed circuit board 64 of the circuit arrangement is also shown in FIG. 5. Further electrical and electronic components arranged on the printed circuit board 64 have not been illustrated. By way of example, the switch 62 can be a push switch, a rocker switch or a slide switch.

The electrical switch 62 is situated in the interior of a housing of the hearing device. Of the housing, FIG. 5 illustrates part of a housing shell 66. The housing shell 66 can be produced from plastics, e.g. ABS.

The button 60 is arranged in a passage opening of the housing shell 66. The passage opening is larger than the button 60, and so there are gaps 68 between the button 60 and the housing shell 66.

There is a film 70 on the outside of the hearing device. The film 70 adheres to the housing shell 66. It can also adhere to the button 60. The film 70 consists of an elastic material. By way of example, it can be produced from a polycarbonate (PC) or a polyethylene terephthalate (PET). The film 70 covers the gaps 68 toward the outside. As a result, neither dirt nor moisture can reach the interior of the hearing device, e.g. the printed circuit board 64, through the gaps.

The film 70 is elastic. In order to switch the switch 62, a user moves the button 60 with respect to the housing shell 66. This changes the width of the gaps 68. Here, the film 70 adapts its shape to the position of the switch.

The arrangement of the button 60, the housing shell 66 and the film 70 can be produced as follows. The film 70 can initially be preformed. The film 70 is subsequently placed into a mold. The housing shell 66 is then molded onto the film 70 by injection molding. The button 60 is then molded onto the film 70 by a second mold, e.g. likewise by injection molding.

In the hearing device illustrated in FIG. 5, the film 70 has a plurality of functions. First, it closes off the gaps 68 toward the outside, resulting in the previously described protection for the interior of the hearing device. The film 70 holds the button 60 in a certain position with respect to the housing shell 66. This simplifies the assembly of the hearing device.

Figure 6:
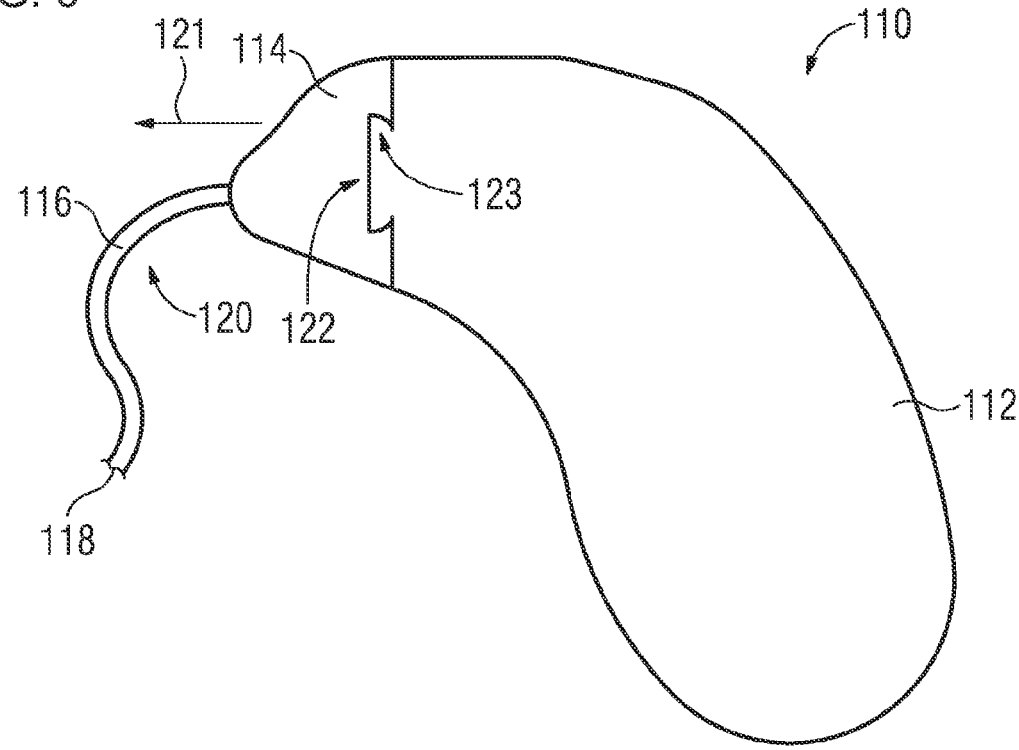
FIG. 6 is a diagrammatic, side view of a second embodiment of the hearing aid according to the invention.

FIG. 6 shows a behind-the-ear hearing aid 110 with a housing 112, an ear hook 114 and a sound tube 116 with an attachment region 120. In principle, the behind-the-ear hearing aid 110 corresponds to the instrument explained above with reference to FIG. 2; to this extent, reference is made to the preceding explanations in the following text.

The housing 112 is connected to the ear hook 114 in a reversibly detachable fashion by a dovetail joint 122. Unlike the embodiment explained above, the dovetail joint 122 does not have straight edges but rounded edges 123.

Figure 7:
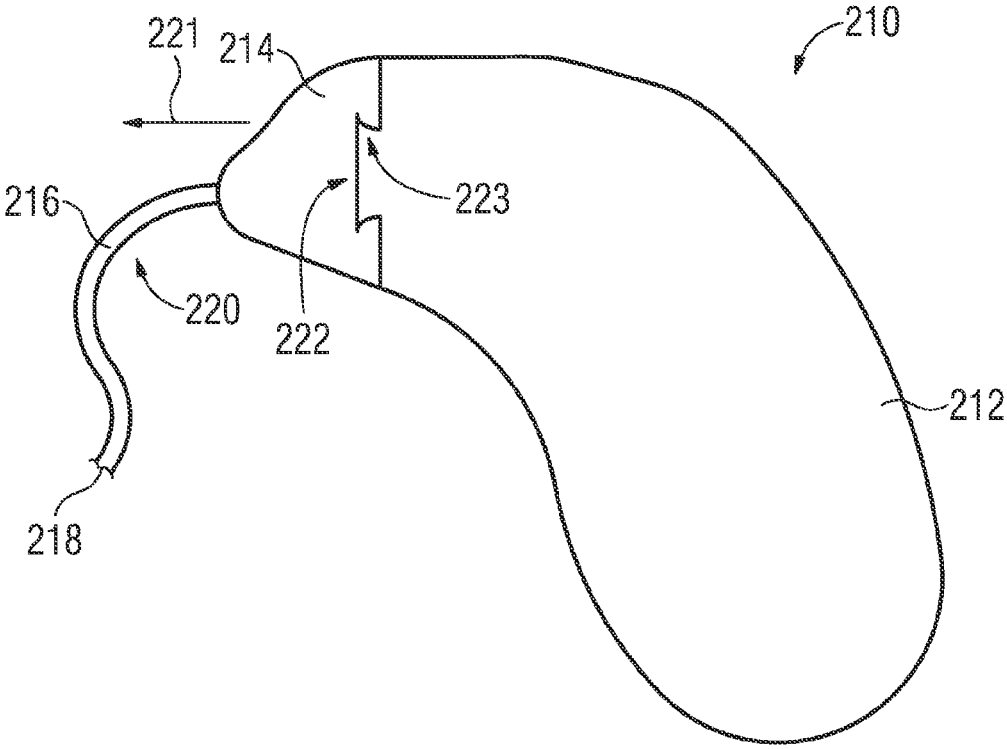
FIG. 7 is a diagrammatic, side view of a third embodiment of the hearing aid according to the invention

FIG. 7 shows a behind-the-ear hearing aid 210 with a housing 212, an ear hook 214 and a sound tube 216 with an attachment region 220. In principle, the behind-the-ear hearing aid 210 corresponds to the instruments explained above with reference to FIG. 2 and FIG. 6; to this extent, reference is made to the preceding explanations in the following text.

The housing 212 is connected to the ear hook 214 in a reversibly detachable fashion by a dovetail joint 222. Unlike the embodiments explained above, the dovetail joint 222 has rounded edges 223 with an inverted curvature.

The examples show how a detachable connection between an ear hook and a hearing-aid housing is made possible in a hearing device, wherein the connection can easily be detached and re-established by a user. This detachable connection also has particularly low wear and tear. Moreover, it is demonstrated how components in an interior of a housing in a hearing device can be protected from dirt and moisture.

The invention claimed is:

1. A hearing device, comprising:

a housing;

a coupling element connected to said housing in a reversibly detachable fashion via a dovetail joint; and a conducting element for conducting sound and/or electrical signals, said conducting element being held against said housing by said coupling element;

said housing and said coupling element each having a passage opening formed therein in a region of said dovetail joint, through said passage opening sound produced in an interior of said housing emerging from said housing and entering said conducting element via said coupling element;

one of said housing or said coupling element having a base, said base being a first component of said dovetail joint having said first component and a second component, said base having an end face with one of said passage openings, said base having side walls extending from said end face, said side walls of said base being inclined such that an undercut is formed in said base, said undercut forming guides along which said second component of said dovetail joint can be pushed onto said base for completing said dovetail joint, said second component being pushed onto said base along a push direction in a linear movement.

2. The hearing device according to claim 1, wherein said coupling element for a connection to said housing is pushed on at an angle to a direction of extent in which said conducting element extends away from said coupling element.

3. The hearing device according to claim 1, wherein said dovetail joint has a housing-side component configured in an integral fashion with a shell part of said housing.

4. The hearing device according to claim 1, further comprising an O-ring surrounding at least one of said passage openings.

5. The hearing device according to claim 1, wherein in a region of said dovetail joint, said housing and said coupling element each have at least one electrical contact for transmitting an electrical signal.

6. The hearing device according to claim 1, wherein said dovetail joint has rounded edges.

7. The hearing device according to claim 1, wherein said coupling element for a connection to said housing is pushed on at an angle to a direction of extent being perpendicular thereto, in which said conducting element extends away from said coupling element.

8. A conduction configuration for a hearing device having a housing with a first component, comprising:

a conducting element for conducting sound and/or electrical signals; and a coupling element to provide a detachable connection between said conducting element and the housing of the hearing device, said coupling element having a second component and the first component and said second component forming a dovetail joint;

the housing and said coupling element each having a passage opening formed therein in a region of said dovetail joint, through said passage opening sound produced in an interior of the housing emerging from the housing and entering said conducting element via said coupling element;

the housing having a base, the base being the first component of said dovetail joint, the base having an end face with one of the passage openings, the base having side walls extending from the end face, the side walls of the base being inclined such that an undercut is formed in the base, the undercut forming guides along which said second component of said dovetail joint can be pushed onto the base for completing said dovetail joint, said second component being pushed onto the base along a push direction in a linear movement.

* * * * *